United States Patent [19]

Martin

[11] Patent Number: 4,785,286

[45] Date of Patent: Nov. 15, 1988

[54] ALARM UNIT FOR PANIC BAR TYPE DOOR OPERATOR

[76] Inventor: Frank J. Martin, 2240 Gale Rd., Ann Arbor, Mich. 48105

[21] Appl. No.: 824,483

[22] Filed: Jan. 31, 1986

[51] Int. Cl.[4] ..... G08B 13/08; E05B 65/10

[52] U.S. Cl. ..... 340/545; 292/92; 70/92

[58] Field of Search ..... 340/545, 542, 693; 292/92, 144; 70/92, 277, 279, 282

[56] References Cited

U.S. PATENT DOCUMENTS

| | | | |
|---|---|---|---|
| 3,432,631 | 3/1969 | Deutscher et al. | 70/92 |
| 3,435,643 | 4/1969 | Pollak et al. | 340/545 |
| 3,508,233 | 4/1970 | Sugiyama | 340/577 |
| 3,677,043 | 7/1972 | Cox | 70/92 |
| 3,801,144 | 4/1974 | Diehl | 70/92 |
| 3,873,141 | 3/1975 | Peterson | 70/92 |
| 3,877,262 | 4/1975 | Williams | 70/92 |
| 4,006,471 | 2/1977 | Pappas | 340/545 |
| 4,081,980 | 4/1978 | Hightower | 70/92 |
| 4,418,552 | 12/1983 | Nolin | 70/92 |
| 4,627,649 | 12/1986 | Leplat | 292/92 |
| 4,631,528 | 12/1986 | Handel et al. | 340/545 |

*Primary Examiner*—John Chapman
*Assistant Examiner*—Hezron E. Williams
*Attorney, Agent, or Firm*—Rhodes and Boller

[57] ABSTRACT

Improvements in a panic bar door operator assembly include a self-contained alarm unit, and a remote unlatching mechanism. The alarm unit comprises a separate key-switch assembly and a separate alarm assembly which separably mount on the housing of the panic bar assembly in a cooperative relationship with the panic bar operator. The key-switch assembly is selectively operable to armed and disarmed settings and also to an access setting. In the access setting, the alarm switch of the alarm assembly is in its disarmed position and an alarm cannot be given, and in this position an adjacent cover member can be removed to provide access to the interior of the alarm assembly, particularly for battery replacement where self-contained batteries power the alarm. In the disarmed setting, the key-switch assembly latches the cover member on the housing so that it cannot be removed and in this setting an alarm will not be given when the panic bar is operated. In the armed setting, the cover member remains latched and the electrical switch of the alarm assembly is disposed for actuation by the push bar so that when the push bar is operated an alarm will be given. Also included is a latching function which causes the electrical switch to remain latched in the armed setting once it has been actuated by the push bar to give an alarm. The remote unlatching feature enables the door to be unlatched without giving an alarm, even if the unit is in the armed setting. They key-switch assembly has a rotary actuator disk which controls the cover latch function and the arming and disarming of the alarm assembly.

39 Claims, 7 Drawing Sheets

ALARM UNIT FOR PANIC BAR TYPE DOOR OPERATOR

BACKGROUND AND SUMMARY OF THE INVENTION

This invention relates generally to panic bar type door operator mechanisms, and more particularly it is concerned with a novel alarm unit for cooperative association with a panic bar type door operator mechanism.

Many commercial and institutional buildings have doors which include panic bar type door operator mechanisms on one side of the door. Normally the doors are latched in the closed position by some type of latch or bolt mechanism and the purpose of the panic bar mechanism is to enable such a latch or bolt mechanism to be operated to an unlatched condition by pushing on the panic bar operator.

There are various types of panic bar assemblies some of which comprise a pivotally mounted operator. Other types comprise an operator which is guided for straight line motion toward the door. While it is with respect to this latter type of panic bar operator that the preferred embodiment of the present invention is disclosed, it will be appreciated that certain principles of the invention may be applicable to other types of panic bar operators and mechanisms.

Because of the security aspects which typically accompany these types of doors, it is often useful for a warning to be given when an attempt is made to open a door by operation of the panic bar mechanism. In the disclosed embodiment of the present invention, an alarm unit is integrally incorporated into the panic bar assembly in association with the mechanism. This unit, when armed, is capable of emitting an audible warning from the panic bar assembly when an attempt is made to operate the panic bar. Principles of the invention can be used to give a remote warning signal in addition or alternatively to the local alarm.

A further feature of the invention is that the unit has the ability to be selectively armed and disarmed. When the unit is disarmed, operation of the panic bar will not cause an alarm to be given.

Still another feature of the invention, which is particularly useful for a self-contained alarm device such as an audible battery-operated one, is the ability of the alarm unit to provide convenient access for maintenance, battery replacement, and/or testing.

Still further attributes of the invention involve the organization and arrangement of various component parts. The preferred embodiment contains an efficient and effective design and organization of component parts which enables the unit to be efficiently fabricated, assembled and maintained. It is also cost-effective. Several of the individual components perform multiple functions. The maintenance function referred to above, is accomplished through use of the key which is utilized to arm and disarm the alarm unit. For instance, access for battery replacement can be accomplished without having to disassemble internal component parts of the mechanism. This feature is accomplished by making the key switch an assembly which is separate from the alarm assembly, but wherein the two assemblies come into cooperative association simply by virtue of mounting the key switch assembly on the panic bar.

The foregoing, as well as additional features, advantages, and benefits of the invention will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 4:
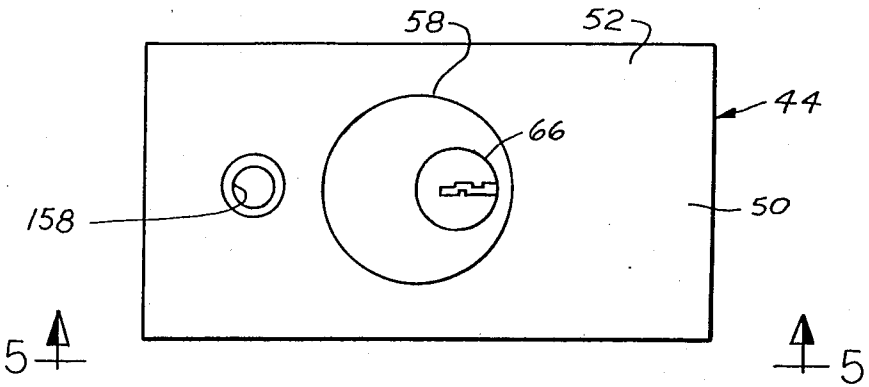
FIG. 4 is an enlarged fragmentary view taken in circle 4 of FIG. 1.
Figure 3:
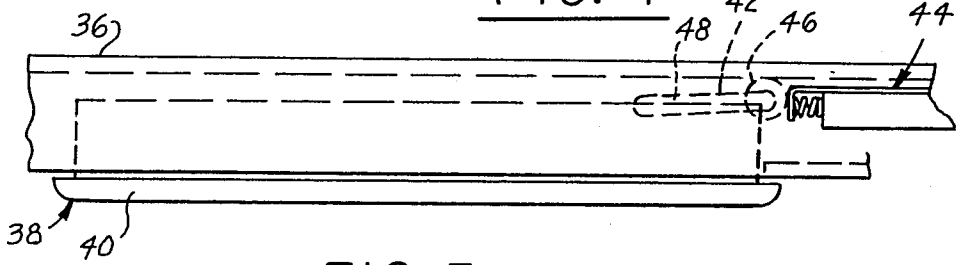
FIG. 3 is a view similar to FIG. 2 illustrating the panic bar actuation.

Many commercial and institutional buildings have doors which include a panic bar type operator mechanism. Such a mechanism is disposed on one side of the door and when operated by an individual pushing on the bar, it unlatches the door so that it can be opened. There are different types of commercial panic bar assemblies and certain aspects of the present invention are particularly well suited for one type of panic bar assembly although certain principles may be applied to other types as well. Therefore in FIGS. 1 through 4 the illustrated panic bar assembly is shown for purposes of illustration of an exemplary embodiment with which the preferred embodiment of the invention is associated.

FIGS. 1–4 show illustrative usage of a preferred embodiment of the invention. A door 30 comprises a panic bar assembly 32 on one side. Normally the door is latched in locked position by any of several types of conventional latch mechanism (not shown). The panic bar assembly is operatively coupled with the latch mechanism so that when the panic bar assembly is operated by an individual, the door becomes unlocked, thereby enabling it to be pushed open from the side containing the panic bar assembly.

Panic bar assembly 32 is illustrative of a particular embodiment with which the preferred embodiment of the present invention is adapted to be used. It comprises an elongate channel 36, preferably an extrusion, whose transverse cross sectional shape is best seen with reference to FIG. 6. The interior of the extrusion is hollow, and in the assembly a portion of the interior is occupied by an operator mechanism, 38 generally, including a push bar 40.

Figure 2:
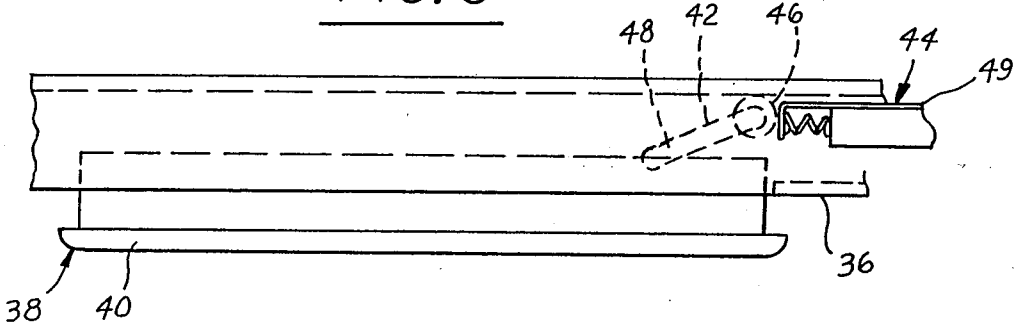
FIG. 2 is a fragmentary top plan view on an enlarged scale looking in the direction of arrows 2—2 in FIG. 1.

The push bar is resiliently biased to the non-actuated position shown in FIG. 2. When the push bar is pushed inwardly to the actuated FIG. 3 position, it causes the door latch mechanism to unlock, enabling the door to be pushed open. The illustrated push bar 40 is guided for linear operational displacement toward the door, a direction which is transverse to the length of channel 36.

Push bar 40 carries an alarm unit actuator 42 which is used to actuate an alarm unit 44 embodying the present invention. The alarm actuator 42 comprises a roller 46 rotatably mounted on one end of an arm 48 whose other end is pivotally mounted on push bar 40. In the position of FIG. 2, arm 48 is at an acute angle to the direction in which the push bar will be pushed when the door is to be unlocked. The roller 46 is adapted to roll along a surface parallel to the length of channel 36. Hence, when the push bar is pushed from the FIG. 2 to the FIG. 3 position, the alarm actuator 42 will actuate the alarm unit 44, provided that the alarm unit is in its armed setting. When the push bar is released, actuator 42 will return to the FIG. 2 position. As will be subsequently explained, the alarm unit includes a latching function so that an alarm continues to be given after the push bar is released after having once actuated the alarm unit. The alarm unit is shown in subsequent FIGS. 5 through 23 and details will subsequently be explained. For now it is sufficient to note that the alarm unit comprises an alarm assembly 49 disposed within the interior of channel 36 adjacent the path of travel of the push bar. Alarm assembly 49 is shown by itself in FIG. 19.

Unit 44 also comprises a key-switch assembly 50 cooperatively associated with alarm assembly 49 for selectively arming and disarming the alarm unit. The key switch assembly is disposed adjacent the push bar and it overlies the alarm assembly. The key switch assembly has a unique cooperative association not only with the alarm assembly, but also in the manner of its mounting on channel 36.

Figure 5:
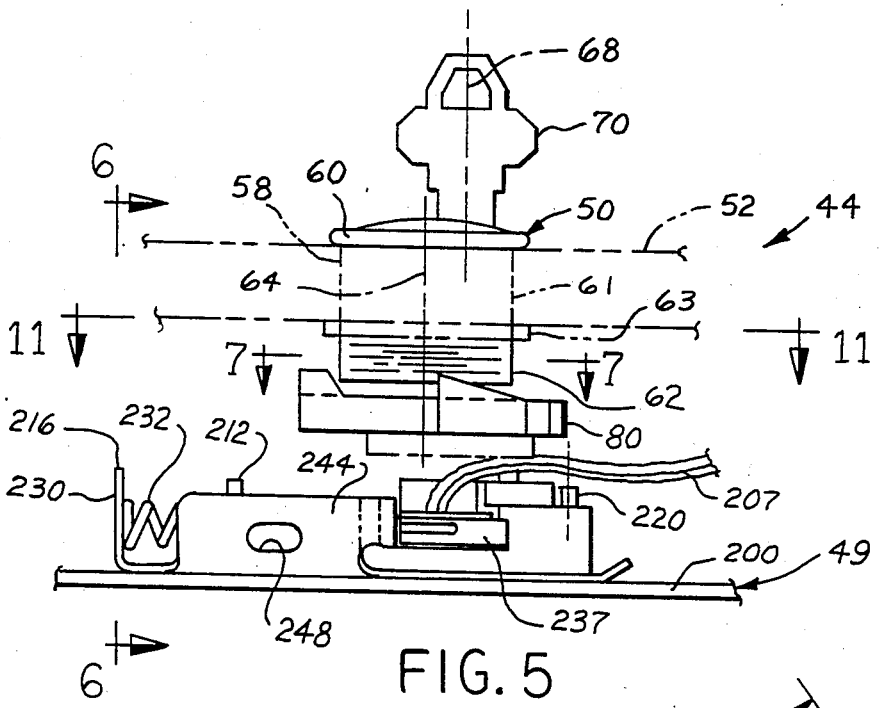
FIG. 5 is a transverse cross sectional view taken generally in the direction of arrows 5—5 in FIG. 4, certain portions being omitted for purposes of clarity.
Figure 7:
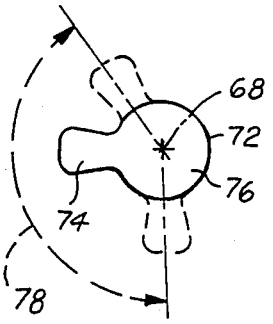
FIG. 7 is a fragmentary cross sectional view taken in the direction of arrows 7—7 in FIG. 5.
Figure 6:
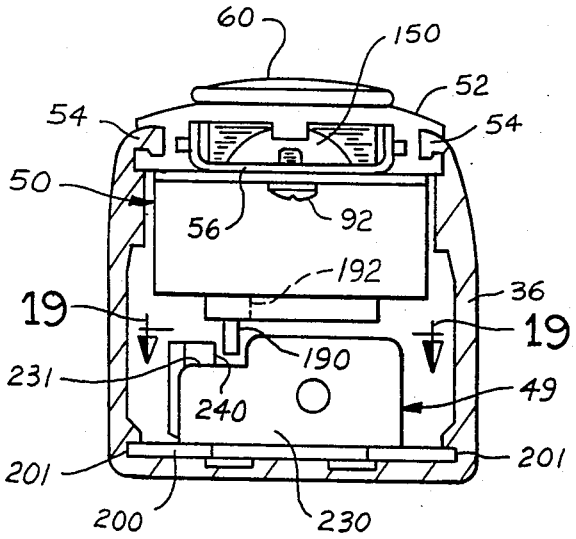
FIG. 6 is a transverse cross sectional view taken in the direction of arrows 6—6 in FIG. 5 illustrating further detail.

FIGS. 5, 6 and 7 illustrate further detail of channel 36 and key-switch assembly 50. Key-switch assembly 50 comprises a mounting portion which includes a cover member 52, preferably in the form of an extrusion. The cover member 52 has a transverse cross sectional shape, perhaps best shown in FIG. 6. It possesses a longitudinal sliding fit on channel 36 which is provided by interlocking tongue and groove type joints, 54 generally. Member 52 may be considered to have a channel shaped form, but much shallower than channel 36.

A stamped metal insert member 56 fits closely within the interior of cover member 52. The two members 52 and 56 are held in assembled relationship by a key cylinder mechanism 58.

Key cylinder mechanism 58 comprises a head 60 on the exterior face of cover member 52 and a body 61 which extends through suitable circular holes in the two members 52 and 56. Body 61 includes an external threaded portion 62 onto which a nut 63 is threaded. As nut 63 is tightened against member 56, head 60 is drawn against the exterior surface of cover member 52 thereby securing key cylinder mechanism 58 and members 52 and 56 in assembled relation.

The geometrical axis of mechanism 58 is identified by the reference numeral 64. The key cylinder barrel 66 (see FIG. 4) has its axis 68 eccentric to axis 64. FIG. 5 shows a key 70 inserted into the key cylinder barrel 66. The interior end of the key cylinder barrel has a member 72 of substantially uniform thickness. The member 72 is shown by itself in FIG. 7 and is seen to comprise a projecting tab 74 which projects radially from a central portion 76, the central portion being coaxial with axis 68.

With the proper key 70 inserted into the key cylinder barrel 66 the exposed portion of the key may be rotated to cause a corresponding rotation of the member 72 about axis 68. In the assembled mechanism the key cylinder barrel is constrained to an angular range of rotary motion of approximately 135° as designated by the reference numeral 78 in FIG. 7, although when the key cylinder mechanism is separate from its assembled relationship the barrel can be freely rotated a full 360° via the proper key.

It is by member 72 that the key assembly has cooperative association with additional portions of the mechanism. Specifically the member 72 serves to operate a rotary actuator disk, generally 80, which in turn serves to operate several portions of the mechanism. One of these operations is the arming and disarming of alarm assembly 49. Another is the operation of a visual indicator to indicate armed status of the alarm, and still another is the releasable locking of an adjacent cover in place on channel 36. An aspect of this latter operation is the feature that when the key switch assembly 50 is operated to an unlocked position the adjacent cover may be slid axially along the channel member 36 so as to provide access to the alarm assembly for maintenance and/or other purposes, hereinafter explained. Also key switch assembly 50 inherently establishes an operative coupling with alarm assembly 49 simply by the act of axially sliding the alarm assembly along channel 36 to its installed position.

Figure 8:
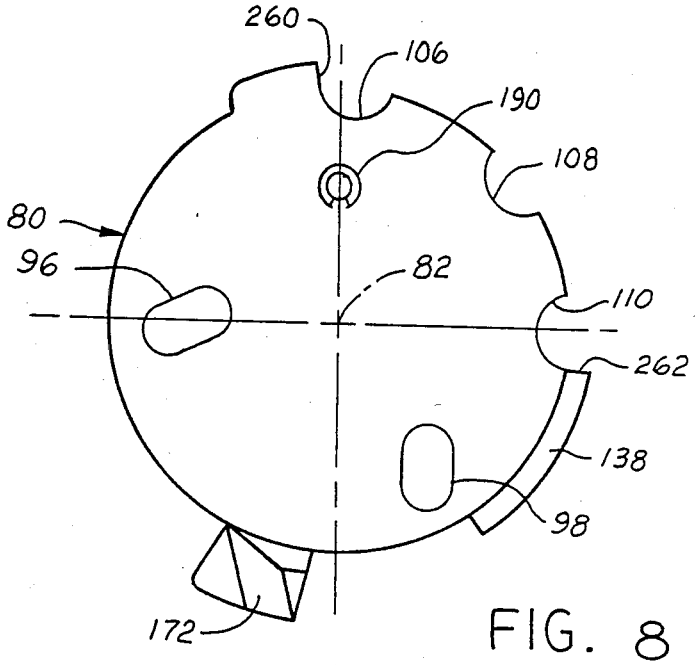
FIGS. 8, 9 and 10 are front facial, side, and rear facial views respectively of one of the component parts of FIG. 5 shown by itself, the view of FIG. 8 being for the same setting as FIG. 13, hereinafter described, and FIGS. 9 and 10 being developed from FIG. 8.
Figure 9:
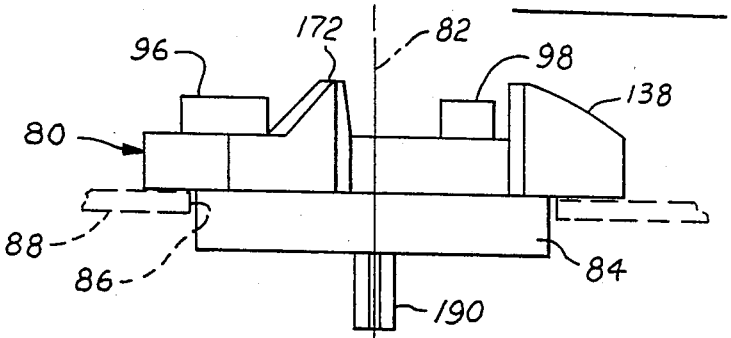
Figure 10:
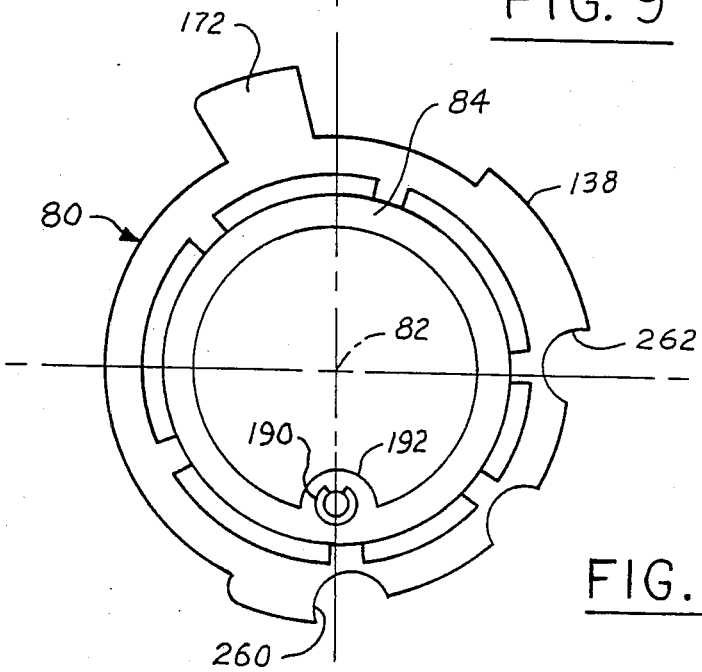

The actuator disk 80 is shown by itself in FIGS. 8, 9 and 10. Disk 80 is of a generally circular shape and its axis is identified by the reference numeral 82. It is not necessary for this axis to be directly coincident with axis 68. The front face of actuator disk 80 confronts member 72. The rear face comprises a circular wall or flange 84 which projects axially rearwardly to fit closely within a circular hole 86 formed in a stamped bracket 88 which is fastened in assembled relationship to insert member 56. (FIG. 9)

Figure 17:
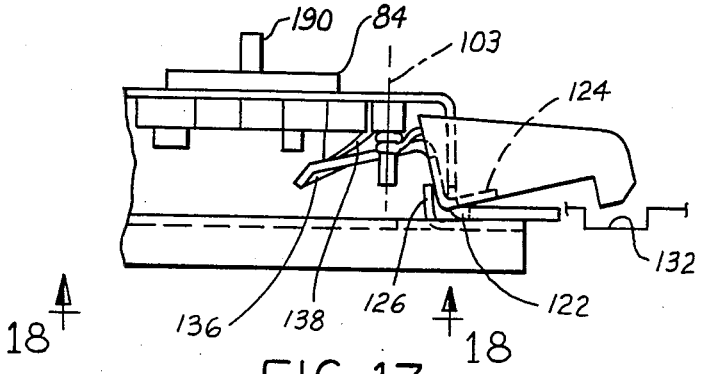
FIG. 17 is a fragmentary view looking in the same direction as FIG. 15 but for the same setting of FIG. 13.
Figure 15:
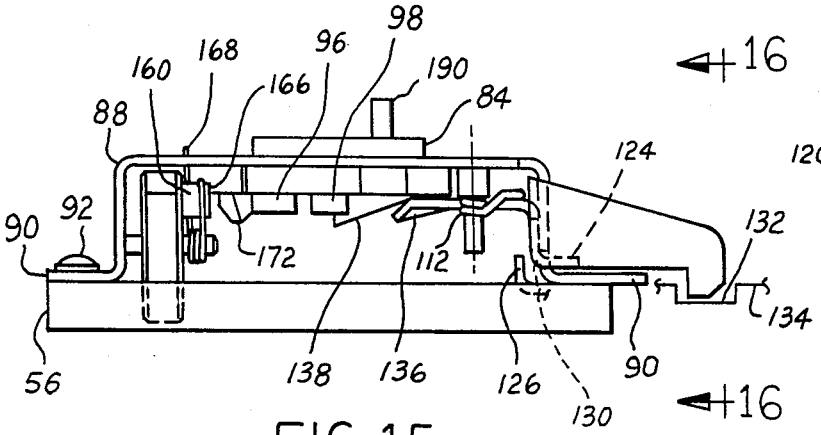
FIG. 15 is a view taken in the direction of arrows 15—15 in FIG. 14.
Figure 16:
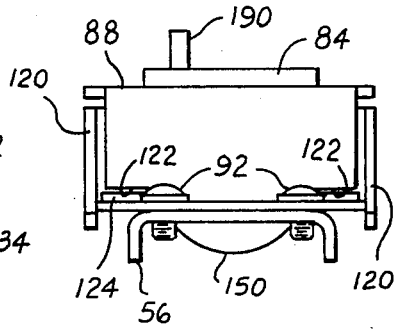
FIG. 16 is a view taken in the direction of arrows 16—16 in FIG. 15.
Figure 14:
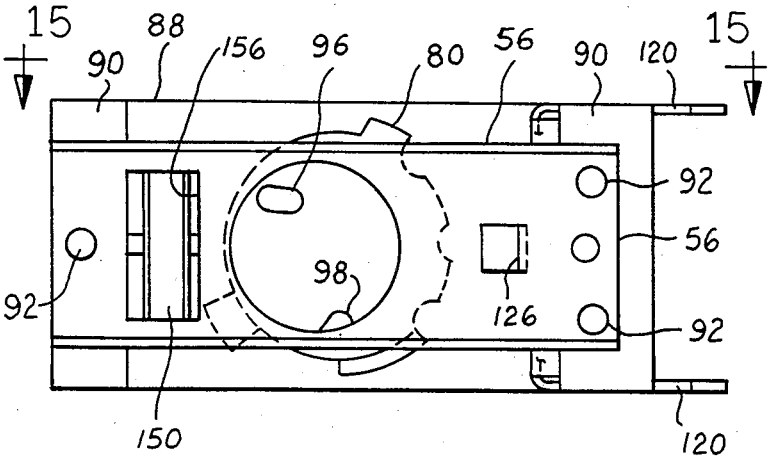
FIG. 14 is a view similar, and for the same setting as, FIG. 12, but including additional structural detail.
Figure 18:
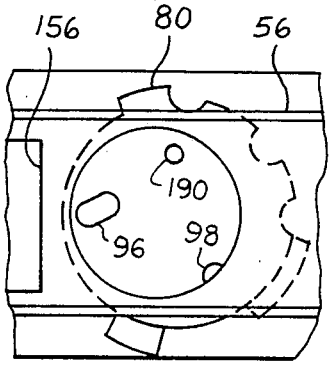
FIG. 18 is a fragmentary view in the direction of arrows 18—18 in FIG. 17.

The shape of bracket 88 can perhaps be best seen from consideration of FIGS. 15, 16 and 17, and as appears in FIG. 15, it may be considered to have a main channel shape with projecting flanges 90 via which it attaches to the member 56. Attachment is effected by screws 92. With bracket 88 so attached, actuator disk 80 is axially captured between key cylinder mechanism 58 and the portion of bracket 88 which contains hole 86. There is a sufficient amount of axial clearance however to permit the disk to be rotated within hole 86 by member 72 in response to key operation.

The front face of actuator disk 80 comprises spaced apart pads 96, 98 which project axially forwardly a distance from that face sufficient to be disposed in the rotary path of travel of the projecting tab 74 of member 72. In assembly, tab 74 is disposed between the two pads 96, 98 (see FIGS. 11, 12 and 13.)

Hence when the key is operated to rotate in the clockwise sense as viewed from the key side of the mechanism, tab 74 will hit pad 96. Continued rotation will cause the actuator disk to also rotate in the clockwise direction.

Figure 11:
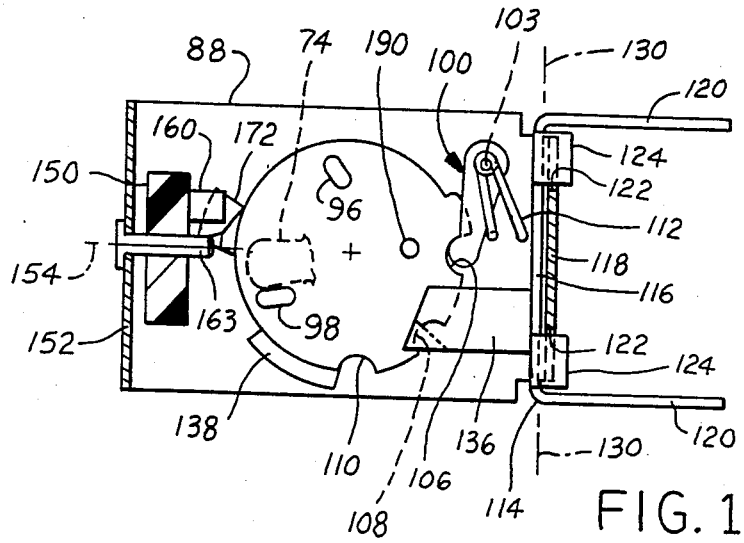
FIG. 11 is a cross sectional view taken generally in the direction of arrows 11—11 in FIG. 5 and representative of one setting.
Figure 12:
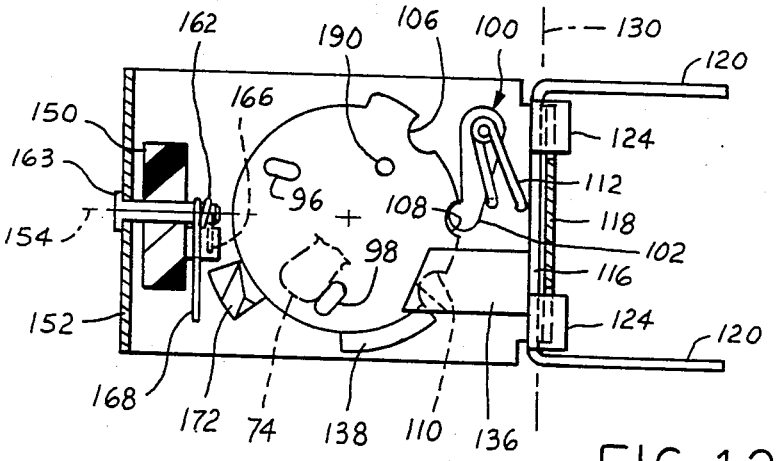
FIG. 12 is a view similar to FIG. 11 illustrating a second setting.
Figure 13:
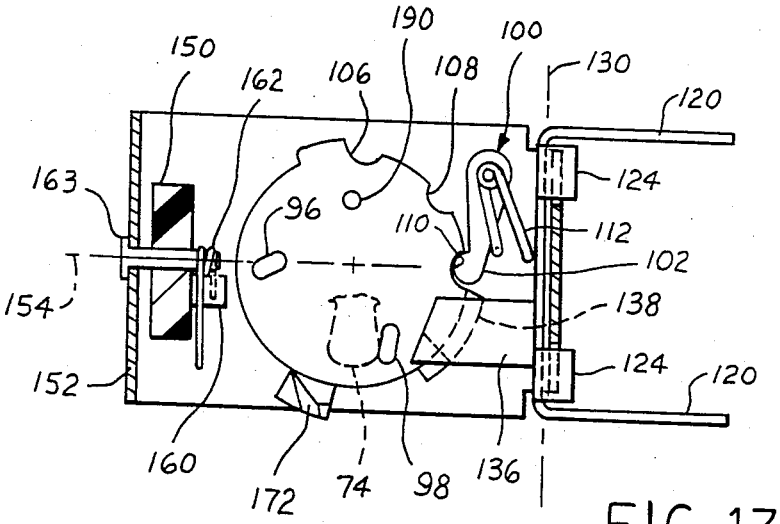
FIG. 13 is a view similar to FIGS. 11 and 12 illustrating a third setting.

When the key is rotated in the other direction, tab 74 will hit the other pad 98 whereupon continued rotation will rotate the actuator disk counter-clockwise. There is a range of lost-motion for tab 74 between the two pads when changing rotation of one sense to the other. In the disclosed embodiment there are three positions for the actuator disk, depicted respectively by FIGS. 11, 12 and 13. These define three settings for the unit. The FIG. 11 position identifies the armed setting, FIG. 12 identifies the disarmed setting and FIG. 13 defines the maintenance access setting. FIG. 11 represents the clockwise-most position of rotation and FIG. 13 the counter-clockwise most.

The three settings are defined by a detent mechanism, 100 generally. The detent mechanism comprises a pawl 102 which is pivotally mounted on member 88 about an axis 103. There are a series of three circumferentially spaced indentations in the circumferential edge of actuator disk 80, and they are identified by the respective reference numerals 106, 108 and 110. Engagement of the free end of pawl 102 with indentation 106 defines the armed setting. Engagement of pawl 102 with indentation 108 defines the disarmed setting, and engagement of the pawl with indentation 110 defines the maintenance access setting.

Pawl 102 is spring-loaded by means of a formed wire torsion spring 112. One end of the formed wire spring bears against the pawl in radially spaced relation to axis 103 while the other end bears against a stamped metal catch member 114. The arrangement is effective to resiliently bias the pawl against the edge of the actuator disk.

The stamped metal catch member 114 is cooperatively associated with member 56 and bracket 88. Member 114 may be considered to have a main body 116 which is substantially flat and rectangular and disposed to confront the inside of one side 118 of bracket 88. Member 114 is also formed with catches 120 terminating in free hook-like ends. These catches project from the shorter opposite sides of main body 116.

Bracket 88 is formed with a pair of slots 122 extending into it from opposite sides to the juncture of side 118 and the contiguous flange 90. The stamped metal catch member 114 has tabs 124 which project away from main body 116 to fit into slots 122.

Insert member 56 contains a tab 126 which is lanced centrally in a direction almost perpendicular to the main portion of the channel. The tab 126 serves to hold the main body 116 in a generally confronting relationship with side 118, at least along the edge which contains the tabs 124. The formed wire spring 112 acts upon catch member 114 in spaced relation to the engagement of tabs 124 with slots 122 thereby resiliently urging the catch member against side 118.

The relative fittings of the tabs and slots are such that the catch member is enabled to pivot about an axis designated by the general reference numeral 130. In this way the member can pivot between the two positions shown in FIGS. 15 and 17. In the position of FIG. 15 the hook-like ends of catches 120 are in the catch position to lock an adjacent cover member 134 in place on channel 36 after the cover member has been slid onto channel 36. The hook-like ends engage with notches 132 provided in the cover member. The catch member maintains this position for both the armed setting and the disarmed setting of the alarm unit.

In the access setting however the actuator disk is effective to cause the catch member to rotate to the position shown in FIG. 17. In this position the hook-like ends are clear of notches 132 and therefore allow cover member 134 to be slid axially along the channel away from the key switch assembly thereby rendering alarm assembly 49 accessible.

The operative connection between the actuator disk and the catch member is formed by a cam and follower mechanism. The follower is in the form of an arm 136 integrally formed with catch member 114 and projecting generally to extend into overlying relationship with the front face of the actuator disk adjacent its circumferential edge. The follower 136 acts with respect to the catch member of the manner of the lever. The end of the follower which over lies the cam disk is disposed in the path of travel of a cam 138 which is integrally formed in the actuator disk. The cam is in the form of an inclined ramp with the direction of inclination increasing in a clockwise sense about the actuator disk.

When the key cylinder mechanism is operated from the disarmed to the access setting, the cam comes into operative engagement with the follower 136 causing the member 114 to be operated from the position of FIG. 15 to the position of FIG. 17. As the cam's ramp engages the arm, the arm in effect rides up the ramp to impart the rocking motion to the catch member. It is convenient for the leading edge of the lever which confronts the ramp to be turned slightly upward to form a leading flank.

Also associated with the key switch assembly is an indicator to indicate armed or disarmed status. The indicator is in the form of a wheel 150 which is disposed in confronting relationship to the side 152 of bracket 88 opposite side 118. The wheel is mounted for rotation on side 152 about an axis identified by the reference numeral 154. A clearance slot 156 for wheel 150 is provided in insert member 56 to provide a restricted view from the key side of the assembly of a limited angular extent of the perimeter of the wheel, the view being through an even smaller hole 158 in the cover member. The perimeter of the wheel is provided with suitable indicia to indicate the status, and a convenient way for doing this is by imparting particular color differentiation to portions of the perimeter of the wheel.

The wheel contains an integrally formed projection 160 which projects parallel to axis 154 but in radially outwardly spaced relation to that axis. A formed wire spring 162 has a cooperative association with the wheel and projection 160 in the following way.

Several turns of the spring are disposed around the pivot pin 163 on which the wheel rotates. One leg 166 of the spring extends to engage projection 160 in a manner which will urge the wheel in a counter-clockwise sense about axis 154 as viewed in the direction of FIG. 6. The other leg 168 of the spring extends in an interference relationship across the projection and thence is hooked into a small hole in bracket 88. This latter leg serves to form one circumferential limit of motion for the wheel and serves to define the normal bias position. This normal bias position is assumed when the key switch is in the access and the disarmed settings, and hence the portion of the perimeter of the wheel which is visible through hole 158 for these two settings contains a suitable color to indicate disarmed status, such as green. When the key switch is operated from the disarmed to the armed setting, another cam 172 on the actuator disk engages projection 160 on the wheel to rotate the wheel in a clockwise sense about axis 154 as viewed in FIG. 6. In the armed setting the wheel will have rotated to expose in hole 158 an indicator of armed status, for example the color red. It is to be observed that although the indicator can be seen through the hole it is not possible for the key mechanism to be operated via the wheel. In other words it is impossible for someone to disarm an armed system or arm a disarmed one by attempting to manipulate the indicator wheel through the hole 158.

Thus far it has been details of the key switch assembly which have been described. It is now appropriate to describe details of the alarm assembly and the operative coupling between it and the key switch assembly. The operative coupling between the two assemblies include a circular pin 190 which projects away from the actuator disk's rear face. Specifically a boss 192 is provided in the actuator disk adjacent flange 84, and pin 190 is fitted securely into this boss. (See FIGS. 6 and 10.)

Figure 19:
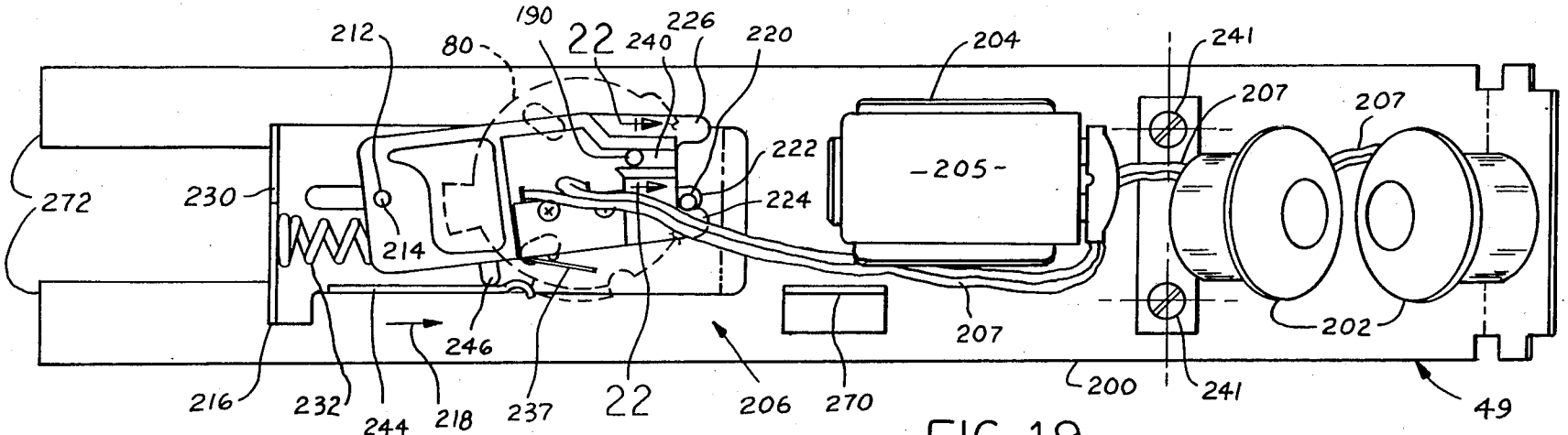
FIG. 19 is a view taken generally in the direction of arrows 19—19 in FIG. 6, with certain portions omitted for clarity.

Alarm assembly 49 is shown by itself in FIG. 19. It comprises a main mounting plate 200 on which the several component parts are mounted. The mounting plate slides into the channel via grooves 201 (see FIG. 6.). The component parts on the mounting plate are a pair of conventional horns 202 attached by suitable brackets adjacent the right aand end of mounting plate 200, a battery retainer 204 on the mounting plate to the left of the horns for retaining batteries for operating the horns, and a switch assembly 206 to the left of the batteries. The battery retainer is shown to contain a pair of conventional batteries 205, such as 9 volt dry cell alkaline batteries. The batteries and the horn are connected by means of wires 207 in a series electrical circuit with switch assembly 206. The switch assembly is normally an open circuit but when it is actuated closed, the batteries energize the horns theeeby causing an audible warning to be emitted.

Figure 20:
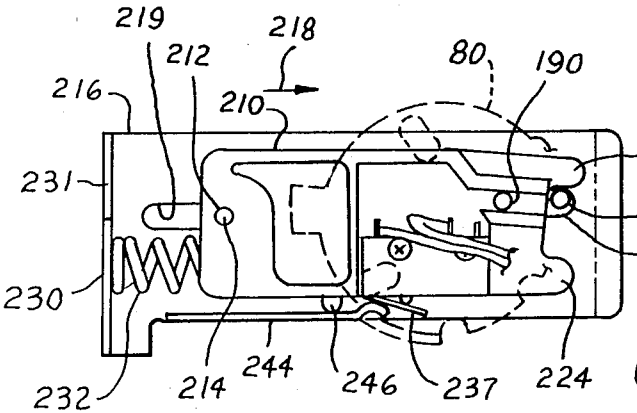
FIG. 20 is a view taken of a portion of FIG. 19 by itself for a different setting, namely the same setting as FIG. 11.

FIG. 19 shows switch assembly 206 in its disarmed position. The switch assembly occupies its disarmed position in both the disarmed setting and the access setting of the key switch. When the key switch is operated to the armed setting, switch assembly 206 assumes its armed position, as shown in FIG. 20, hereinafter explained.

Switch assembly 206 comprises a main body 210 which may be molded non-metallic, for example. This main body is pivotally mounted on a pin 212 for pivotal motion about the pin's axis 214. Pin 212 is staked to mcunting plate 200.

Disposed between main body 210 and mounting plate 200 is a stamped metal slide operator member 216 which is guided for motion in the direction of arrows 218. For this purpose member 216 includes an elongate slot 219 through which pin 212 passes. There is a second pin 220 staked on mounting plate 200 in spaced relation but parallel to pin 212. Member 216 contains a second slot 222 through which pin 220 passes. The two slots 219, 222 are parallel with each other.

The main body 210 includes stops 224 and 226 which have a cooperative association with pin 220. Specifically the pin is disposed between the two stops, with stop 224 defining a counter-clockwise limit of pivoting for main body 210 about axis 214 (FIG. 19) while the other stop 226 defines a clockwise limit (FIG. 20).

One end of slide operator member 216 contains a flange 230. A helical compression spring 232 is disposed between this flange and the confronting side of body 210, the ends of the spring being associated with respective locators on the flange and the body. Spring 232 acts in spaced relation to the axis 214 urging body 210 in a counter-clockwise sense. Hence the spring is effective to resiliently bias the switch assembly to the position shown in FIG. 19 with stop 224 abutting pin 220.

A lever-operated microswitch 236 fits onto body 210. The microswitch has a lever 237 which has a pivotal mounting so that when pushed against the side of the microswitch's body it will operate the switch contacts into closure. In the position shown in FIG. 19 the switch contacts are open, and they remain open when the assembly is operated to the armed position of FIG. 20. It will subsequently be explained how the microswitch is actuated closed in response to an unauthorized attempt to operate the panic bar when the unit is in the armed setting. First there will be an explanation of the cooperative mounting relationship of alarm assembly 49, key-switch assembly 50, and the push bar on channel 36.

Figure 1:
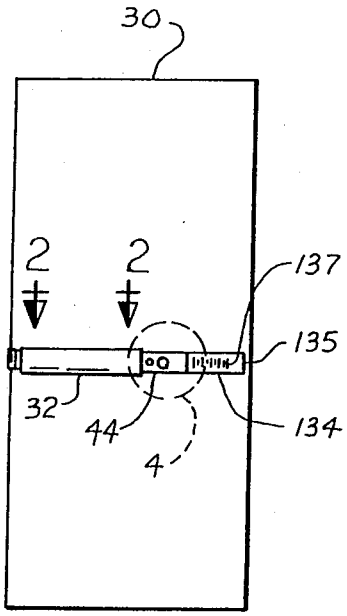
FIG. 1 is a front elevational view of a door containing a panic bar assembly embodying principles of the present invention.

The panic bar operator mechanism 38 is contained on a frame which is designed to mount on channel 36 by a sliding engagement with the same grooves 201 of the channel (see FIG. 6) as mounting plate 200. After the panic bar mechanism and its frame have been assembled into channel 36, the right hand end of the channel, as viewed in FIG. 1, is open to receive key-switch assembly 50 and alarm assembly 49. First, key-switch assembly is slid into the channel from the open right hand end. This is followed by sliding the alarm assembly into the channel also via the open right hand end.

A locator 270 projects perpendicularly away from the plane of mounting plate 200 sufficiently far so as to be in an interference relationship with the outside surface of the side 118 of bracket 88 of the key-switch assembly so that locator 270 captures the key-switch assembly from the right.

The left hand end 272 of mounting plate 200 is adapted to abut the right hand end frame of the panic bar operator mechanism inserted into grooves 201 thereby to define the extent to which the alarm assembly can be slid onto the channel. When the alarm assembly has been fully inserted into the channel so that the left hand end of mounting plate 200 abuts the frame of the panic bar operator mechanism, locator 270 has so located the key-switch assembly that the left-hand edge of the key-switch assembly cover member 52 is disposed against the right side of push bar 40 (see FIGS. 2 and 3). Hence key-switch assembly 50 is captured on the left by the panic bar mechanism and push bar and on the right by the alarm unit, but in such a way that the key-switch assembly is in correct operative relationship with the alarm assembly and that the alarm assembly is in correct operative relationship to the panic bar mechanism for actuation by roller 46. The mounting plate 200 is locked in place on channel 36 by one or more screws 241 which are threaded into the mounting plate and whose tips bear against the back of channel 36. With the mounting plate so locked, the key-switch assembly is also secured in place because it is constrained by the alarm assembly against the push bar.

The flange 230 of member 216 includes a cutout notch 231 permitting pin 190 to pass the flange during assembly of the key-switch assembly and alarm assembly to the channel so long as the key-switch assembly is not in the armed position. Body 210 is shaped with a slot 240 whose left-hand end is open for reception of the free end of pin 190 after assembly.

The pin 190 is located in the correct position at the open left hand end of slot 240.

With key 70 in the access setting, catch member 114 is in the FIG. 17 position allowing cover member 134 to be slid onto channel 36 to abut cover member 52 of key-switch assembly 50. Operation of the key from the access setting will cause the hook-like ends of the catches 120 to enter notches 132 and lock the cover member 134 in place.

When the key-switch assembly is being operated from the access to the disarmed setting, pin 190 is positioned in the left hand end of slot 240. This is depicted in FIG. 19. Thus, pin 190 enters slot 240 as catches 120 are engaging notches 132. With the cover member 134 now latched on channel 36 by catch member 114, operation of the key from the disarmed setting to the armed setting will cause further rotation of pin 190 about the actuator disk axis 82.

Pin 190 has an interaction with slot 240 in the manner of a cam and follower (see FIG. 22) so that as a consequence the switch assembly is rotated from the FIG. 19 to the FIG. 20 position. The alarm unit is now armed.

Figure 21:
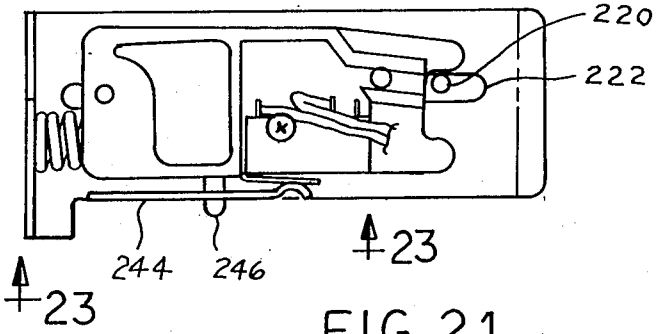
FIG. 21 is a view similar to FIG. 20 illustrating the same setting, but after actuation.
Figure 22:
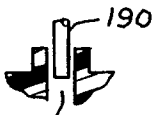
FIG. 22 is a fragmentary sectional view taken in the direction of arrows 22—22 in FIG. 19.
Figure 23:
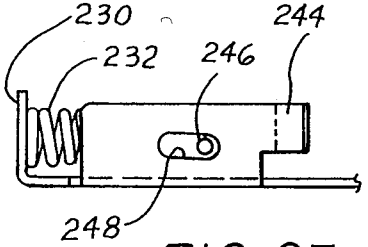
FIG. 23 is a fragmentary view looking in the direction of arrows 23—23 in FIG. 19.

If an attempt is made to operate the panic bar the actuator 42 will hit flange 230 pushing it toward body 210. The member 216 contains a further flange 244 generally perpendicular to flange 230 and it is this second flange 244 whose leading (i.e. right hand) edge operates microswitch lever 237 as the member 216 is slid to the right. At the point of microswitch closure, a spring-loaded pin 246 which had previously been bearing against flange 244 drops into an elongated hole 248 and thereby latches member 216 in position where switch closure is maintained. This is shown in FIGS. 21 and 23. Hence once switch 206 has been actuated by operation of the panic bar, the alarm continues to be given even after the panic bar is released.

It was stated earlier that the key switch assembly constrains the rotary motion of member 72 to a range of approximately 135°. This constraint is provided by a pair of stops 260, 262 which are formed as radial projections from the circumferential edge of the actuator disk. The stops are in an interference relationship with the free end of pawl 102 if an attempt is made to rotate the disk 80 in either direction beyond the range of travel defined by the stops.

The releasable locking of cover member 134 on channel 36 by key-switch assembly's catch member 114 provides a convenient means for obtaining access to the alarm assembly for maintenance or other purposes, particularly for battery replacement when the batteries are self-contained. By making one end cap 135 integrally attached to cover member 134 the right hand end of the assembly is fully closed when the cover member is locked in place on the channel. When it is unlocked by operating the key-switch assembly in the access position, end cap 135 and cover member 134 can be slid off together. The cover member 134 may have apertures in the form of a series of slots 137 as shown in FIG. 1 through which the sound of the alarm is emitted when actuated.

It is also possible to utilize the alarm device for a remote alarm indication if that is desired. In connection with remote activities it may be desirable for a door such as that shown in FIG. 1 to be remotely unlatched. This can be done by the mechanism shown in FIGS. 24 and 25.

Figure 25:
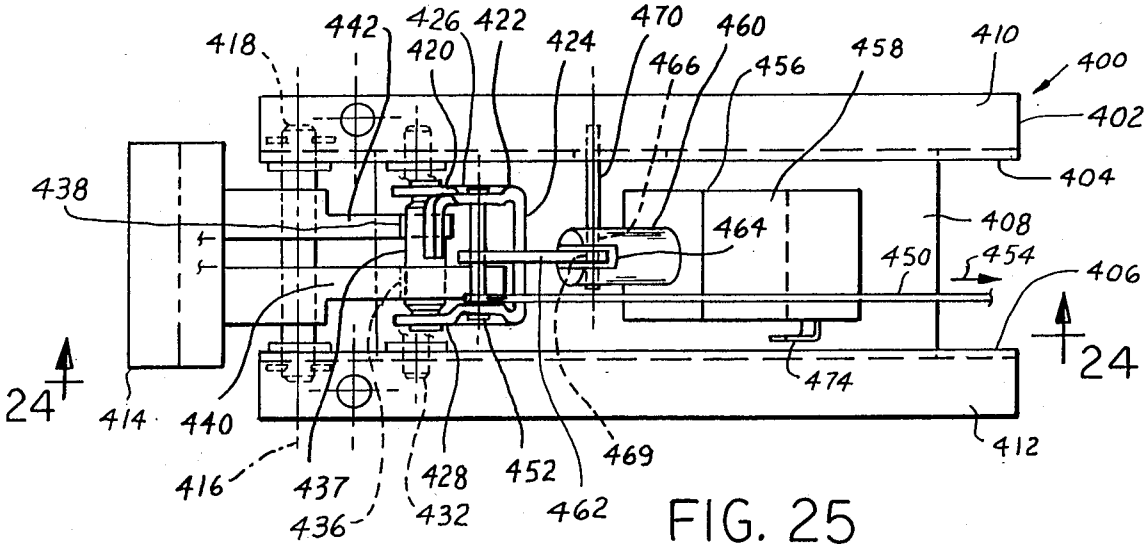
FIG. 25 is an elevational view of additional mechanism.
Figure 24:
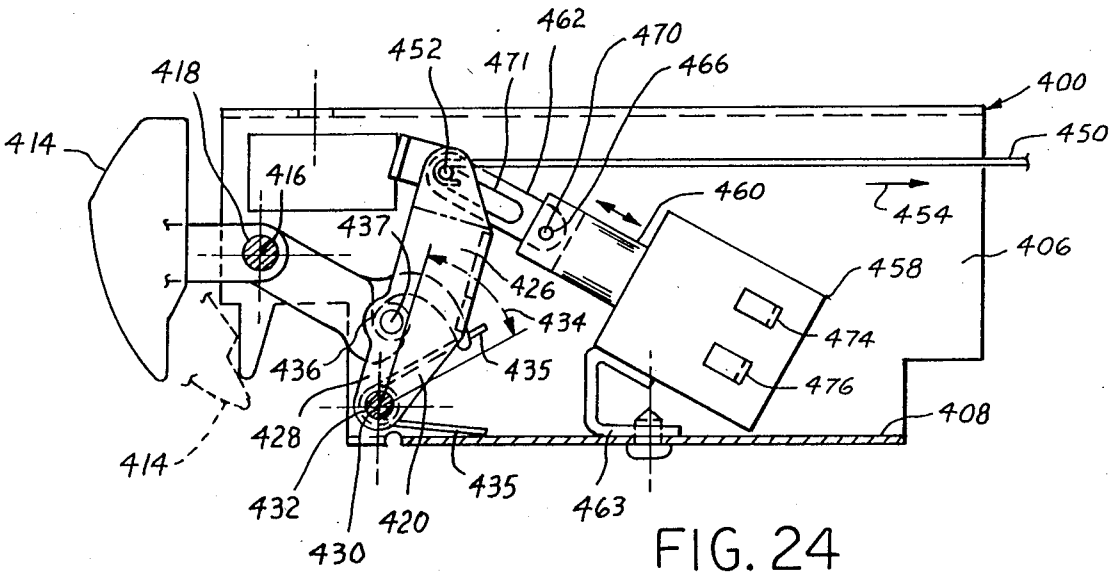
FIG. 24 is a cross sectional view as taken in the direction of arrows 24—24 in FIG. 25.

FIG. 24 is a view in the same direction as FIG. 2, and FIG. 25 is a rear view but with certain parts broken away for clarity. These Figures show a latching and unlatching mechanism 400 which is disposed at the left hand end of the panic bar assembly in FIG. 1. It comprises a stamped metal frame 402 in the general form of a channel-shaped member having horizontally disposed parallel sides 404, 406 joined by a vertical back 408. The distal ends of sides 404, 406 terminate in vertical flanges 410, 412 via which the mechanism can slide into grooves 201 of channel 36, and in this regard the frame 402 may be a part of the panic bar frame previously referred to.

A catch member 414 is supported for rotation about a vertical axis 416 by means of a pin 418 which extends between the two sides 404, 406. The member 414 is operable about axis 416 to a latched position shown in the solid lines and an unlatched position represented by the broken lines.

A control lever 420 is cooperatively associated with catch member 414. Control lever 420 is in the form of a stamped metal member 422 which has a vertical back 424 and horizontal sides 426 and 428. The lever 420 is pivoted about a vertical axis 430 via a pin 432 extending between the sides 404, 406. In this way the control lever is enabled to execute arcuate motion along the arc indicated by the reference numeral 434. A formed wire torsion spring 435 is disposed around pin 432 and has its free legs associated respectively with lever member 422 and the frame back 408 for urging the lever in the counterclockwise direction as viewed in FIG. 24. A circular cylindrical roller 437 is disposed between the two sides 426, 428 of bracket 422 and in the position shown in the drawing figure has a fit with slots 436, 438 formed in arms 440, 442 projecting from the catch member 414 which serves to lock the catch member in the latching position. If the control lever pivots in the clockwise direction of FIG. 24 about axis 430 it disengages the slots 436, 438 and allows the catch member to operate to the unlatching position. However in the latched condition, the point of action of arms 440, 442 on roller 437 is over-center relative to the arcuate swing of control lever 420 whereby if a force is applied to the catch member 414 in a direction seeking to move it to the unlatched position, it will be resisted by the control lever so that the mechanism remains latched. In other words, once the catch member is in the latched position, it is locked there by the control lever and the only way to release the catch is by operating the control lever.

An operator member 450 is shown operatively associated with control lever 420. The specific connection of the operator member is to a pin 452 which passes between the two sides 426, 428 in spaced relation to axis 430. The operating member 450 may be operatively associated with the push bar such that when the push bar is pushed in from the FIG. 2 to the FIG. 3 position, the member 450 moves in the sense indicated by the arrow 454 to cause the control lever to release the catch member from the latched position.

It may be desirable in connection with the remote activities referred to above to provide for the ability to remotely unlatch the catch member 414. FIGS. 24 and 25 disclose such a remotely operable mechanism in cooperative association therewith. The mechanism comprises a solenoid 456 having a main body 458 and a moveable plunger 460. The solenoid is shown mounted in somewhat close proximity to control lever 420 with the plunger 460 being operatively connected with control lever 420 by a link member 462. It is possible however for the solenoid to be mounted in a more distant location within the panic bar assembly and connected with the control lever by a longer link.

The illustrated embodiment shows the solenoid body 458 being attached by a suitable nounting structure 463 to the back 408 of the frame 402. The body 458 is disposed between sides 404 and 406. The line of action of plunger 460 is preferably along a tangent line to the arcuate swing of control lever 420 about axis 430 but exact tangency is not critical.

The illustrated plunger 460 is in the form of a circular cylinder and it is diametrically slotted by an open ended horizontal slot 464. The slot 464 is intercepted by a transverse vertical hole 466. One end of link 462 is inserted into slot 464 and a connection between actuator and link is established by a pin 470 passing through the hole 466 and through a hole 469 in the link. The link also contains a lengthwise slot 471 through which pin 452 passes.

FIGS. 24 and 25 show the latched condition and the solenoid de-energized. Under this condition the pin 452 is at the far end of slot 471 relative to pin 470. Energization of the solenoid is accomplished via lead wires (not shown) connecting to terminals 474, 476. When the solenoid is energized, plunger 460 will be retracted a certain extent into the solenoid body thereby pulling link 462 along with it. The link in turn pulls the control lever in the clockwise sense about axis 430 as viewed in FIG. 24 and this serves to release the control lever roller 437 from the slots 436, 438 in the catch member arms allowing the catch member to operate to the unlatching position.

Preferably the organization and arrangement of control lever 420 to the push bar is such that operation of the solenoid plunger does not encounter any resistance from operating member 450. In other words there may be a lost motion connection in the push bar operated system whereby the rotation of the control lever from the latching to the unlatching position by the solenoid does not cause any significant movement in the push bar operating mechanism. So long as the solenoid remains energized, the catch member cannot be latched. When the solenoid is de-energized the catch member will also remain in the unlatching position until such time as it is operated to the latching position.

The remote actuating unlatching mechanism does not interfere with the normal push bar operation because the slot in link 462 provides a lost motion connection. The illustrated remote unlatching mechanism is particularly advantageous because of its unique organization and arrangement with the panic bar assembly. Also, its operation will not cause an alarm to be given because the solenoid will not cause the push bar to be pulled into the channel.

Thus the disclosure has been shown to set forth improvements in a panic bar assembly for a door control mechanism. While a preferred embodiment has been disclosed, it will be appreciated that principles are applicable to other embodiments.

When the alarm is given, it can be shut off only by use of the key to operate the alarm assembly from the armed position to the disarmed position.

What is claimed is:

1. In a panic bar door operator assembly of the type comprising a push bar moveably mounted on a housing for causing an associated door to be unlatched when the push bar is operated by operating a catch member of the associated door from latched to unlatched position, the improvement comprising an alarm unit disposed on the housing in cooperative assembly relationship with the push bar for giving an alarm in response to operation of the push bar, in which said alarm unit is selectively operable to armed and disarmed settings so that when in the disarmed setting, operation of the push bar will not cause an alarm to be given but when in the armed setting, operation of the push bar will cause an alarm to be given, including a remote unlatching mechanism cooperatively associated with the panic bar door operator assembly for operating the catch member of the associated door from latched position to unlatched position without causing an alarm to be given even if the alarm unit is in the armed setting.

2. The improvement set forth in claim 1 in which a control lever is cooperatively associated with the catch member for controlling a catch member, and the remote unlatching mechanism comprises a solenoid having a plunger and a link including a lost motion connection from the solenoid plunger to the control lever for operating the control lever to a position which releases the catch member from latched position and in which the remote unlatching mechanism does not interfere with the regular operation of the control lever by the panic bar door operator assembly from the push bar.

3. The improvement set forth in claim 2 in which said push bar is operable toward and away from the door along a straight line.

4. In a panic bar door operator assembly of the type comprising a push bar moveably mounted on a housing for latching and unlatching an associated door via a catch member which is selectively operable to latched and unlatched positions and which is under control of a control lever such that the catch member is incapable of being operated from the latched to the unlatched position unless the control lever is in a releases position relative to the catch member, the improvement which comprises a remote unlatching mechanism within said housing cooperatively associated with the control lever comprising a solenoid having a plunger and a link including a lost motion connection from the solenoid plunger to the control lever for releasing the control lever to a position which releases the catch member from latched position, and wherein the remote unlatching mechanism does not interfere with the regular operation of the control lever by the push bar except to the extent of overriding the push bar when the remote unlatching mechanism is operated to release the control lever.

5. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit is selectively operable to armed and disarmed settings so that when in the disarmed setting, operation of the push bar will not cause an alarm to be given but when in the armed setting, operation of the push bar will cause an alarm to be given, said alarm unit comprises a key-switch assembly via which the alarm unit is selectively operable to armed and disarmed settings, said key-switch assembly comprises a rotary actuator disk having a cooperative association with an electrical switch assembly to move said electrical switch assembly bodily on the alarm unit selectively to armed and disarmed positions corresponding to said armed and disarmed settings, said electrical switch assembly being disposed for actuation by operation of the push bar when in the armed position but not when in the disarmed position, said alarm unit comprises an alarm assembly which contains said electrical switch assembly and wherein said alarm assembly and said switch assembly are separate self-contained assemblies having separable mounting on the housing but having cooperative association when mounted on the housing.

6. The improvement set forth in claim 5 in which the alarm assembly has a self-contained power source for powering the alarm and said actuator disk is operable when the electrical switch assembly is in its disarmed position, to an access setting which enables an adjacent cover member to be moved on the housing so as to provide access to the self-contained power source.

7. The improvement set forth in claim 6 in which said key-switch asembly comprises a catch member which is selectively operable with respect to the adjacent cover member to catch and retain the adjacent cover member on the housing when the unit is in the armed and disarmed settings but which is operable to release the cover member when the unit is in the access setting.

8. The improvement set forth in claim 7 in which said key-switch assembly further includes a detent mechanism for defining the access, the disarmed, and the armed settings and including a common spring which biases the detent mechanism against the actuator disk and also the catch member toward its catch position.

9. The improvement set forth in claim 7 in which said catch member has a lever which is operated by a cam on said actuator disk.

10. The improvement set forth in claim 5 in which said key-switch assembly further includes a status indicator operated by said actuator disk for indicating armed and disarmed settings.

11. The improvement set forth in claim 10 in which said status indicator comprises a wheel which is mounted for rotation on the key-switch assembly about an axis which is generally transverse to the axis of the rotary actuator disk and including a cam and follower mechanism coupling the wheel and the rotary actuator disk for operating the wheel to provid status indication.

12. The improvement set forth in claim 11 in which the rotary actuator disk is also operable to an access setting providing access to the interior of the housing and in which the cam and follower mechanism is operable to change the status of the disk only for operation between the armed and disarmed settings and not for operation between the disarmed and the access settings.

13. The improvement set forth in claim 11 in which the interaction between the cam and follower is such that the unit, when in the armed setting, cannot be operated to the disarmed setting by back-driving through the indicator wheel.

14. The improvement set forth in claim 11 in which a spring is associated with the indicator wheel to define a particular stopping position for the wheel and to bias the wheel toward that stopping position.

15. The improvement set forth in claim 5 in which the alarm assembly comprises a mounting plate, said electrical switch being pivotally mounted on said mounting plate to be pivoted between armed and disarmed positions by the key-switch assembly.

16. The improvement set forth in claim 15 including a spring biasing the electrical switch towards the disarmed position.

17. The improvement set forth in claim 16 in which the alarm assembly includes a slide operator having a portion thereof disposed between the electrical switch assembly and the mounting plate and another portion for operating the electrical switch assembly.

18. The improvement set forth in claim 17 including means performing a latching function on the electrical switch assembly by the slide operator such that when the electrical switch assembly is in the armed position and the push bar operated to give an alarm, the alarm assembly remains in the alarm-giving position even after the push bar is released.

19. The improvement set forth in claim 18 in which said latching function means comprises a spring-loaded member which rides upon said another portion of the slide operator but which enters a hole in said another portion of the slide operator when the alarm is given, the spring bias imparted to the electrical switch assembly being insufficient to override the engagement of the spring-loaded member with the operator.

20. The improvement set forth in claim 19 in which said another portion of the slide operator comprises a flange which operates the electrical switch assembly and which also contains the hole which the spring-loaded member enters when the alarm is given.

21. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit comprises an actuator member having cam and follower means for selectively operating the alarm unit between the armed and disarmed settings, further including additional cam and follower means for operating a visual status indicator to provide a visual indication of the armed and disarmed status of the alarm unit, in which said cam means are integrally formed with said actuator member, and said actuator member is further operable to a third setting to provide access to the alarm unit by releasing an adjacent cover member on the housing so that the cover member can be moved to an access position, and further comprising further cam and follower means for releasing the cover member, said further cam means also being integrally formed with said actuator member.

22. The improvement set forth in claim 21 in which said actuator member is arranged for rotary motion between the armed and disarmed settings and said cam means are rotary cams.

23. The improvement set forth in claim 21 in which the alarm unit contains batteries which can be replaced via the access provided by removal of the adjacent cover member when the unit is operated to the access position.

24. In a panic bar door operator assembly of the type comprising a push bar moveably mounted on an elongate housing for causing an associated door to be unlatched when the push bar is operated, the improvement comprising an alarm unit disposed on the housing in cooperative assembly relationship with the push bar for giving an alarm in response to operation of the push bar, in which said alarm unit comprises a key-switch assembly and an alarm assembly which are separate units each of which is separably mounted on the housing by sliding engagement lengthwise along the housing and in which the alarm assembly contains means for causing the key-switch assembly to be captured on the housing axially between the alarm assembly and the push bar by first sliding the key-switch assembly along the housing toward the push bar and then sliding the alarm assembly along the housing toward the key-switch assembly with the key-switch assembly and the alarm assembly assuming a correct operative relationship to each other and the push bar by the act of so capturing the key-switch assembly such that the alarm assembly can be operated to the armed and disarmed settings by operation of the key-switch assembly and the alarm assembly will give an alarm in response to operation of the push bar when in the armed setting.

25. The improvement set forth in claim 24 including an adjacent cover member on the housing to the side of the key-switch assembly opposite the push bar and in which the key-switch assembly is also operable to an access setting, and means operated by the key-switch assembly for selectively latching the adjacent cover member on the housing such that when the key switch assembly is in the access position the cover member is unlatched but when the key-switch assembly is in the armed and disarmed settings the cover member is latched.

26. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit is selectively operable to armed and disarmed settings such that in the disarmed setting, operation of the push bar will not cause an alarm to be given, but in the armed setting, operation of the push bar will cause an alarm to be given, said alarm unit comprising selectively operable means operable by authorized use means via which the unit is selectively operated to armed and disarmed settings, and an electrical switch assembly which is disposed on the alarm unit for selective bodily positioning by said selectively operable means such that when the selectively operable means is in the armed setting, said electrical switch assembly bodily occupies an armed position, and when the selectively operable means is in the disarmed setting, said electrical switch assembly bodily occupies a disarmed position in which it has a different bodily orientation on the alarm unit from that which it has when occupying the armed position, said electrical switch assembly, when in armed position, being bodily disposed for actuation in response to operation of the push bar to cause the alarm unit to give an alarm, and said electrical switch assembly, when in disarmed position, being bodily disposed so as not to be actuated in response to operation of the push bar.

27. The improvement set forth in claim 26 in which said electrical switch assembly is disposed for selective bodily positioning about a pivot axis.

28. The improvement set forth in claim 27 in which said electrical switch assembly is disposed on an alarm assembly which contains said pivot axis and wherein said selectively operable means is part of a further assembly, said alarm assembly and said further assembly being separate, self-contained assemblies having separable mounting on the housing but having cooperative association when mounted on the housing.

29. The improvement set forth in claim 28 in which the cooperative association attained between said alarm assembly and said further assembly when mounted on the housing comprises a slot and pin connection for effecting bodily displacement of said electrical switch assembly about said pivot axis.

30. The improvement set forth in claim 29 in which said slot is formed in a body portion of said electrical switch assembly and said pin is on said selectively operable mean.

31. The improvement set forth in claim 26 in which said selectively operable means if further operable to an access setting while the disarmed setting is maintained so as to provide access to the alarm unit by releasing an adjacent cover member on the housing so that the cover member can be moved to an access position without an alarm being given.

32. The improvement set forth in claim 31 in which said selectively operable means is part of a further assembly, said alarm assembly and said further assembly being separate, self-contained assemblies having separable mounting on the housing but having cooperative association when mounted on the housing.

33. The improvement set forth in claim 32 in which said cover member mounts on said housing by longitudinal sliding movement along the length of the housing, and said alarm assembly and said further assembly also mount on said housing by longitudinal sliding movement along the housing, and in which the cooperative asociation which is attained between the alarm assembly and further assembly is effected with the electrical switch assembly in disarmed position and the selectively operable means in disarmed setting during the act of mounting them on the housing.

34. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit is selectively operable to armed and disarmed settings so that when in the disarmed setting, operation of the push bar will not cause an alarm to be given but when in the armed setting, operation of the push bar will cause an alarm to be given, said alarm unit comprises selectively operable means via which the alarm unit is selectively operable to armed and disarmed settings, said selectively operable means having a cooperative association with an electrical switch assembly to move said electrical switch assembly bodily on the alarm unit selectively to armed and disarmed positions corresponding to said armed and disarmed settings, said electrical switch assembly being disposed for actuation by operation of the push bar when in the armed position but not when in the disarmed position, said alarm unit comprises an alarm assembly which contains said electrical switch assembly and wherein said alarm assemnbly and said selectively operable means are separate, self-contained assemblies having separable mounting on the housing but having cooperative association when mounted on the housing.

35. The improvement set forth in claim 34 in which said electrical switch assembly is disposed for selective bodily displacement about a pivot axis.

36. The improvement set forth in claim 35 in which the cooperative association attained between said separate, self-contained assemblies when mounted on the housing comprises a slot and pin connection for effecting bodily displacement of said electrical switch assembly about said pivot axis.

37. The improvement set forth in claim 34 in which said selectively operable means is further operable to an access setting while the disarmed setting is maintained so as to provide access to the alarm unit by releasiing an adjacent cover member on the housing so that the cover member can be moved to an access position without an alarm being given.

38. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit is selectively operable to armed and disarmed settings so that when in the disarmed setting, operation of the push bar will not cause an alarm to be given but when in the armed setting, operation of the push bar will cause an alarm to be given, said alarm unit comprises a key-switch assembly via which the alarm unit is selectively operable to armed and disarmed settings, said key-switch assembly comprises a rotary actuator disk which executes rotary motion about an axis to arm and disarm the alarm unit, and in which said key-switch assembly further includes a status indicator operated by said actuator disk for indicating armed and disarmed settings, said status indicator comprises a wheel which is mounted for rotation on the key-switch assembly about an axis which is generally transverse to the axis of the rotary actuator disk and including a cam and follower mechanism coupling the rotary actuator disk and the wheel for operating the wheel to provide status indication.

39. In a panic bar door operator assembly of the type comprising a push bar moveably mounted on a housing for causing an associated door to be unlatched when the push bar is operated, the improvement comprising an alarm unit disposed on the housing in cooperative assembly relationship with the push bar for giving an alarm in response to operation of the push bar, in which said alarm unit is selectively operable to armed and disarmed settings so that when in the disarmed setting, operation of the push bar will not cause an alarm to be given but when in the armed setting, operation of the push bar will cause an alarm to be given, said alarm unit comprises selectively operable means operable by an authorized use means via which the alarm unit is selectively operable means having a cooperative association with an electrical switch assembly to arm and disarm same such that when said electrical switch assembly is armed and the push bar is operated, said electrical assembly is actuated to cause an alarm to be given, said alarm unit includes a spring-loaded operator via which the electrical switch assembly is actuated, said spring-loaded operator being biased to a direction away from that for actuating said electrical switch assembly, and means performing a latching function on the electrical switch assembly upon actuation thereof by said opeator, said means performing a latching function comprising a spring-loaded member which is disposed between confronting surfaces of said operator and said electrical switch assembly which move relative to each other as said operator operates the electrical switch assembly to actuation, said spring-loaded member being operable to retracted and extended positions and being disposed on one of said confronting surfaces to ride across the other of said confronting surfaces in retracted position as said confronting surfaces move relative to each other and as said electrical switch assembly is actuated by said operator to cause an alarm to be given, said spring-loaded member operates to extended position and enters a hole in the other of said confronting surfaces which prevents the spring-loaded operator from discontinuing actuation of said electrical switch assembly after peration of the push bar has ceased, whereby an alarm once given, continues after operation of the push bar has ceased.

* * * * *